US007570215B2

(12) United States Patent
Abramov et al.

(10) Patent No.: US 7,570,215 B2
(45) Date of Patent: Aug. 4, 2009

(54) ANTENNA DEVICE WITH A CONTROLLED DIRECTIONAL PATTERN AND A PLANAR DIRECTIONAL ANTENNA

(75) Inventors: Oleg Jurievich Abramov, St. Petersburg (RU); Aleksandr Germanovich Kashkarov, St. Petersburg (RU); Farid Ibragimovich Nagaev, St. Petersburg (RU)

(73) Assignee: Airgain, Inc., Carlsbad, CA (US)

( * ) Notice: Subject to any disclaimer, the term of this patent is extended or adjusted under 35 U.S.C. 154(b) by 241 days.

(21) Appl. No.: 10/536,547

(22) PCT Filed: Dec. 2, 2003

(86) PCT No.: PCT/RU03/00542

§ 371 (c)(1),
(2), (4) Date: Jan. 22, 2007

(87) PCT Pub. No.: WO2004/051798

PCT Pub. Date: Jun. 17, 2004

(65) Prior Publication Data

US 2007/0103378 A1 May 10, 2007

(30) Foreign Application Priority Data

Dec. 2, 2002 (RU) ..... 2002132846

(51) Int. Cl.
*H01Q 1/36* (2006.01)

(52) U.S. Cl. ..... 343/700 MS; 343/876

(58) Field of Classification Search ..... 343/700 MS, 343/846, 848, 876
See application file for complete search history.

(56) References Cited

U.S. PATENT DOCUMENTS 5,220,335 A 6/1993 Huang (Continued)

FOREIGN PATENT DOCUMENTS

CH 690 945 2/2001

(Continued)

OTHER PUBLICATIONS

Supplementary European Search Report issued in EP03768429.7 on Apr. 22, 2008.

*Primary Examiner*—HoangAnh T Le
(74) *Attorney, Agent, or Firm*—Procopio, Cory, Hargreaves & Savitch LLP

(57) ABSTRACT

The invention relates to antenna systems used in local wireless communications networks. The antenna system includes planar directional antennas (1), each of which is made as a dielectric plate (2), with an active element (5) of the antenna (1) mounted on said plate. The surface of the plate (2) that faces the active element is metallized and serves as a reflector (6) of the antenna (1). The plates (2) are interconnected along their edges in such a way as to form lateral facets of a hollow frame (9) of the device. The end face (10) is made as a dielectric plate (11) with the external surface metallized and can also contain an active element (12) of the antenna (13). An antenna commutation switch (14) connected to a switch control unit (16) and to active elements (5) of the antennas (1) is mounted on the inner surface of the end face (10) of the frame (9). Active element (5) is mounted on said plate by means of pins cut in the body of the active element (5) and bent during mounting. This invention permits to manufacture structurally simple and inexpensive antennas and antenna systems based on printed circuits and to exclude manual operations from the manufacturing and assembly of said antennas and antenna systems.

12 Claims, 7 Drawing Sheets

U.S. PATENT DOCUMENTS

| | | | | | |
|---|---|---|---|---|---|
| 5,757,324 | A | * | 5/1998 | Helms et al. | 343/700 MS |
| 5,831,578 | A | * | 11/1998 | Lefevre | 343/700 MS |
| 5,914,690 | A | * | 6/1999 | Lehtola et al. | 343/702 |
| 5,995,062 | A | | 11/1999 | Denney et al. | |
| 6,094,176 | A | | 7/2000 | Van Hoozen et al. | |
| 6,101,174 | A | | 8/2000 | Langston | |
| 6,275,192 | B1 | | 8/2001 | Kim | |
| 6,292,153 | B1 | | 9/2001 | Aiello et al. | |
| 6,362,790 | B1 | | 3/2002 | Proctor, Jr. et al. | |
| 7,075,486 | B2 | * | 7/2006 | Suzuki | 343/700 MS |
| 2002/0024468 | A1 | | 2/2002 | Palmer et al. | |

FOREIGN PATENT DOCUMENTS

| | | |
|---|---|---|
| EP | 0540124 | 5/1996 |
| EP | 0923155 | 6/1999 |
| EP | 936 693 | 8/1999 |
| JP | 08032347 | 2/1996 |
| WO | 0243183 | 5/2002 |

* cited by examiner

ANTENNA DEVICE WITH A CONTROLLED DIRECTIONAL PATTERN AND A PLANAR DIRECTIONAL ANTENNA

The invention claimed herein relates to antenna systems and transceiving equipment designed for the transmission and reception of various types of information and used in local wireless communications networks.

The invention claimed herein relates to antenna systems and transceiving equipment designed for the transmission and reception of various types of information and used in local wireless communications networks.

Currently wireless local area communication networks (WLAN) are finding more and more extensive use in the field of information science for the purpose of transmission and distribution of data and other information among multiple users located inside one and the same building (for example, among personal computers, laptop computers, printers and other users located in one and the same building without any restrictions on the "mobility" of these devices). When used in such networks, portable computers are equipped with both antenna systems of various types and various transceiving devices. Antenna systems used for such computers are required to have a high gain coefficient to provide a long range and they should be also small-sized, light in weight and should be easy to manufacture. At the same time they should offer quite a wide range of functional capabilities. The antenna gain coefficient is usually increased by expanding the antenna active surface, and/or by using the directional antennas, and/or by using controlled (steerable) antenna arrays.

An antenna system for portable computers is known which comprises a substrate on one side of which two slot antennas are formed in the conducting layer. Two conducting lines are placed on the other side of said substrate for the purpose of electric connection of slot antennas with appropriate feeder points [1]. In this design one antenna operates in the reception mode, while another antenna operates in the transmission mode, thus making a transmission/reception switch unnecessary. However, the parameters and functional capabilities of this antenna system are quite limited.

Another planar antenna [2] is known that includes a dielectric plate of a given thickness, on the upper and lower surface of which earthed conductive layers are arranged and active elements of the planar antenna are formed. A high-frequency communication line (made in the form of a microstrip) is placed inside the dielectric plate.

The application of antenna elements upon the dielectric plate reduces the antenna size and the effective area surface of said elements, and, hence reduces the antenna gain and widens its directional pattern. Besides, the placement of the high-frequency line inside the plate makes the antenna manufacturing process more complex.

An antenna system with a controlled directional pattern [3] is known that includes a disk-shaped base (made of deformable dielectric material) with radially extending rectangular plates. The plates carry printed antenna elements on both sides, while the lower surface of the disk is made conductive and its upper surface carries electronic components that connect the antenna elements with the transceiver. For the operation of this antenna system, the plates carrying the antenna elements are set perpendicular to the disk plane, and upon the termination of antenna operation, the plates are folded to the disk surface, which permits to diminish the dimensions of the antenna system in inoperable state.

This antenna system is characterized by a complex design, it is difficult to manufacture, and it requires a lengthy manual deployment into operational state.

A planar antenna [4] is known that includes two interconnected dielectric plates, whose external surfaces have log-periodic active antenna elements formed on them; with said active elements being connected to a central earthed conductor. A feeder line is located between the inner surfaces of the dielectric plates.

This planar antenna is characterized by a broad range of working frequencies and small dimensions, though its gain coefficient is inadequate for the purposes in question and the structural design is too complex.

An antenna device with directional antennas [5] is known that includes a stand arranged on its base (with said stand being rotatable along its axis) and at least four dielectric plates, one of which is fixed horizontally on the upper end of the stand, while the other are hinged to the ribs of the horizontal plate. The external surface of each plate has an active element of the planar antenna formed on the surface, while the inner surface carries an antenna reflector. The plates can be rotated either manually, or by a mechanical or electric drive.

This antenna device is characterized by complex structural design and its assembly requires manual labor. Besides, the orientation of each antenna takes significant time.

A planar directional microstrip antenna [6] is known that includes a dielectric plate, one surface of which is covered by an earthed conductive layer, and the other surface carries a reflector, an active element and directors formed as conductive square sites.

This antenna has a narrow directional pattern, which is obtained, however, through the extension of antenna size.

An antenna system [7] that includes a hollow frame shaped as a regular tetrahedral prism, made of a dielectric material and fixed on antenna base, each of the lateral facets of which carries directional antennas on its outer surface, represents the analog closest to the invention claimed herein (i.e. antenna system with controlled directional pattern) in terms of the combination of essential features. The fifth antenna is mounted on the internal partition set vertically in the central part of the frame. The base of this antenna system is formed by several layers of printed boards, with the lower layer being made of metal and earthed, while the others accommodate a power divider, a screen, and a phase-shifting circuit with control communications lines. The antennas are connected to the phase-shifting circuit with coaxial communications lines.

This antenna device provides an invariable vertical position of planes of antenna elements plane relative to the base, thus facilitating the orientation of the antennas in space. However, the prototype of this antenna system is characterized by a complex structural design and is labor-consuming, since its manufacturing requires a number of manual operations.

Another analog closest to the invention claimed herein (i.e. planar directional antenna) in terms of the combination of essential features is a planar antenna [8] that includes an earthed plate with a flat T-shaped active element mounted on it by means of mounting elements in the form of small poles; with said active element being electrically connected to the earthed plate on its one side and to the high-frequency line—on the other side.

The prototype of is planar antenna consists of a great number of separate parts which makes the process of antenna more complex.

The engineering problem that the claimed group of inventions is aimed at is the development of such an antenna system with a controlled directional pattern and a planar directional antenna to be used in said antenna system that, while offering the same advantages as prototypes, could comprise a smaller number of parts, be characterized by simpler and less expensive structural design based on printed circuits, offer broader functional capabilities and high gain coefficient, and make it possible to completely eliminate manual operations from its manufacturing and assembly.

This problem is resolved by the fact that the antenna system with controlled directional pattern claimed herein includes at least three planar directional antennas each of which is made as a dielectric plate, on which a planar active element of antenna is installed at a certain distance from said dielectric plate and parallel to said dielectric plate, while the plate surface facing the active element is metallized and serves as a reflector for the antenna. At that said plates are interconnected along their edges in such a manner that they form lateral facets of a hollow frame shaped as a regular prism with metallized external surface and installed on antenna base; with the end facet of said frame being made as a dielectric plate having its external surface metallized and carrying an antenna switch on the its internal surface, with said antenna switch being connected to the antenna switch control unit by means of control communications lines and to said active antenna elements of antenna by means of high-frequency communications lines.

High-frequency lines in the antenna system may be made as microstrips on the inner surface of all frame facets, while said control communications lines may be located on the inner surface of the end facet and, at least, on one lateral facet of the frame.

Making frame facets of dielectric plates with their external surface (above which planar active elements of the antenna are placed with a gap) being metallized, made it possible to simultaneously employ external surfaces as antenna reflectors and as common communication lines, and to use the inner surfaces of the plates for the purpose of forming an antenna switch, control communication lines, high-frequency communication lines with matching devices (made as microstrips) and other electronic components with said forming performed according to the technology used for the manufacture of single-layer printed-circuit boards. Such an approach makes it possible to significantly simplify the structural design of the antenna system, decrease the number of antenna system components, to eliminate manual steps in the antenna system assembly process, because arranging the plates with metallized external surfaces in a frame and connecting electrically the communication lines formed on the inner surfaces of plates is performed by simple soldering the plate edges.

At least one additional planar element of the planar directional antenna may be additionally mounted on each lateral facet of the frame on its external surface. Said additional planar element is mounted parallel to and spaced from said lateral facet by means of mounting elements. At that active antenna elements located on the same frame facet are spaced from each other along the frame axis, which permits to narrow the directional pattern in the vertical plane. At that a power divider (by which the antenna switch is connected to said active antenna elements) made as sections of a microstrip line may be arranged on the inner surface of each lateral frame facet.

A planar active element of the planar directional antenna (for which the metallized external surface of the end frame facet serves as a reflector) may be mounted on the external side of the end frame facet through the use of mounting elements, parallel to and spaced from said external side. At that the antenna commutation switch is connected to said active element by means of a high-frequency communications line. This approach creates an opportunity for the effective operation of the device in the direction perpendicular to device base.

Said active element of the planar directional antenna located on the end facet of antenna system frame may be made in the shape of a disk, which approach would provide for the match between the active element area and reflector area.

The mounting elements of the active elements of planar directional antennas may be made, for example, in the form of pins.

The connection between the active element of each antenna and the high-frequency communication line may be formed by one of the said pins, which is made electrically conductive and isolated from the metallized external surface of the frame.

This connection between the active element of each antenna and the high-frequency communications lines may be formed by two of the said pins, which are made electrically conductive and isolated from the metallized external surface of the frame; with said two pins contacting said active element in points located on orthogonal straight lines passing through the center of the active element. At that the inner surface of each facet carries a power divider and a phase shifter (made as sections of microstrip line) that are connected in series, with the antenna commutation switch being connected to the active elements of antennas via said sections of microstrip line.

Such an arrangement of pins in respect to the center of the active element permits to receive a signal of different polarization and diminish the nonuniformity of antenna sensitivity, which depends upon antenna position.

The control unit for the antenna commutation switch may be placed inside the frame of the antenna system, which enables one to make the entire antenna system more compact.

In this case the control unit for the antenna commutation switch may be mounted on the base, while the frame of the antenna system may be installed on the base by means of split connectors that are connected to the outputs of the control communication lines of the antenna commutation switch. This approach also permits to speed up and simplify the assembly process for the antenna system.

The frame of the antenna system may be made in the shape of a regular right prism. In this case the structural design of each facet may be the same, which also simplifies the manufacture and assembly process of the antenna system.

The control unit for the antenna commutation switch enables the antenna system to operate in different modes—namely, omnidirectional mode, scanning mode and steady-state directional mode. At that, the antenna commutation switch may switch either one antenna or simultaneously several antennas into the reception-transmission operation, which makes it possible to change the configuration of the directional pattern of the antenna system.

The engineering problem to be solved by the claimed group of inventions is also resolved by the approach that implies that a planar directional antenna that includes a dielectric plate carrying a planar active antenna element mounted by means of mounting elements parallel to and spaced from said plate; with the surface of said plate that faces said active element being metallized and serving as antenna reflector; with said mounting elements made as pins cut in the body of the active antenna element and bent during mounting, may be used in the antenna system claimed herein.

Such an arrangement of the planar antenna results in the reduction of the number of antenna components and simplifies the antenna manufacturing process even further.

One of the said pins in the planar directional antenna may be isolated from the metallized surface of said plate and designed to provide connection with the high-frequency communications line, which may be made as microstrip on the surface of dielectric plate opposing the metalized surface.

Two of the said pins in the planar directional antenna may be isolated from the metallized external surface of said plate, located on orthogonal straight lines passing through the center of the active element and designed to provide connection with the high-frequency communications lines. At that, the surface of said plate, opposing the metallized one, is additionally equipped with high-frequency communications lines, power divider and phase shifter made as microstrips and connected in series; with said phase shifter being connected to said pins.

The invention claimed herein is illustrated by the following diagrams and drawings.

Figure 1:
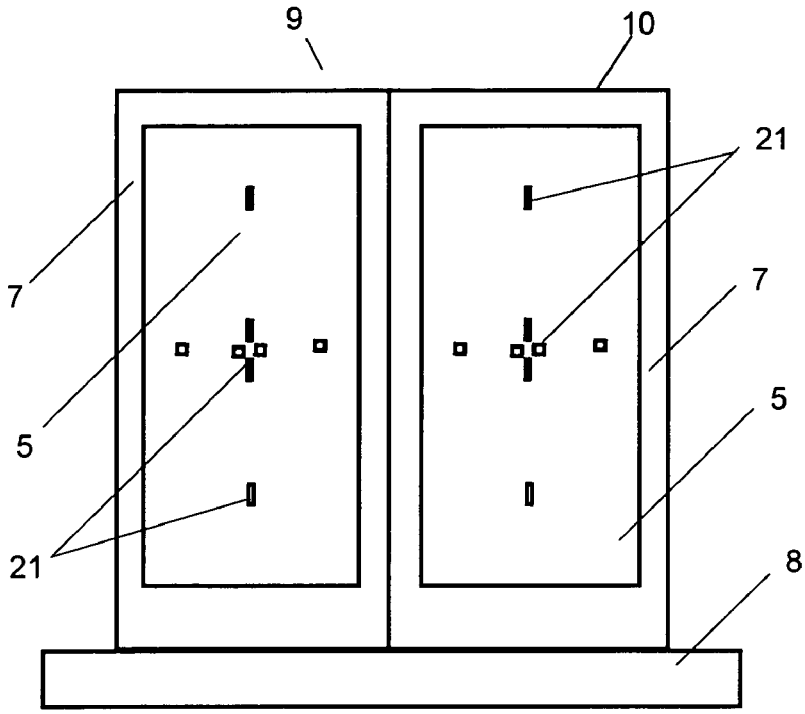
FIG. 1 shows a side view of the antenna system with the frame made as a triangular prism and with three directional planar antennas.
Figure 2:
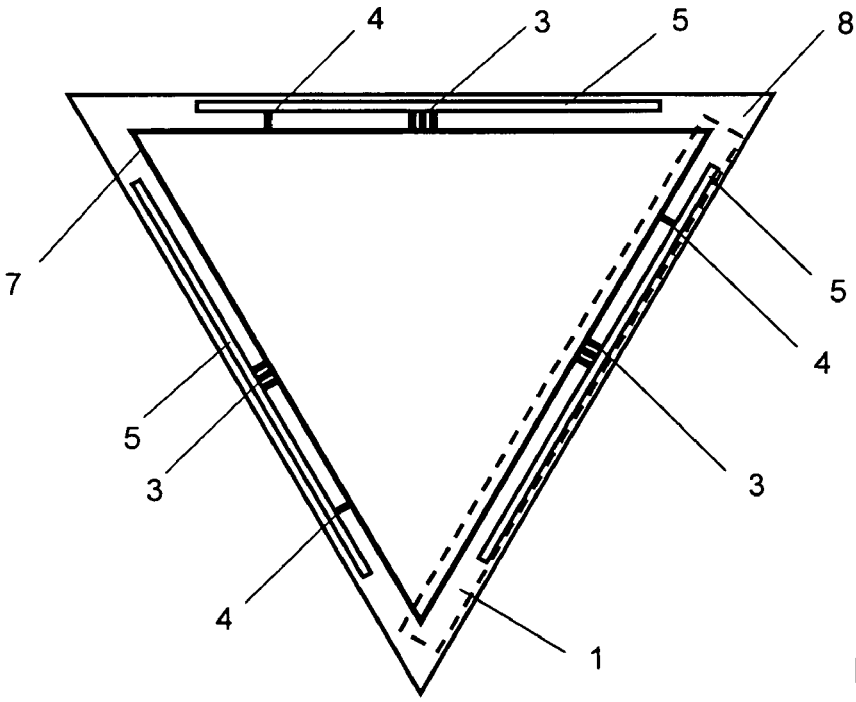
FIG. 2 shows an upper view of the antenna system of FIG. 1.
Figure 7:
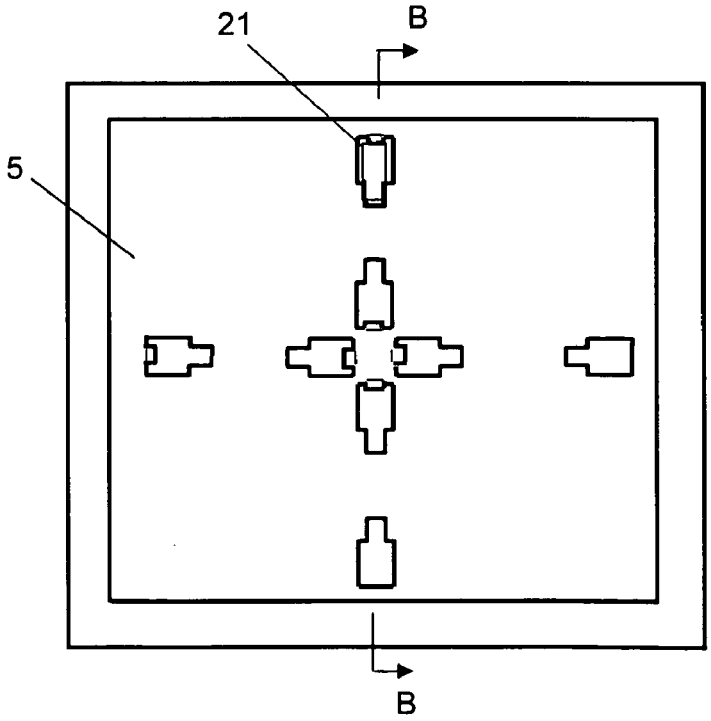
FIG. 7 shows an upper view of the planar directional antenna.
Figure 8:
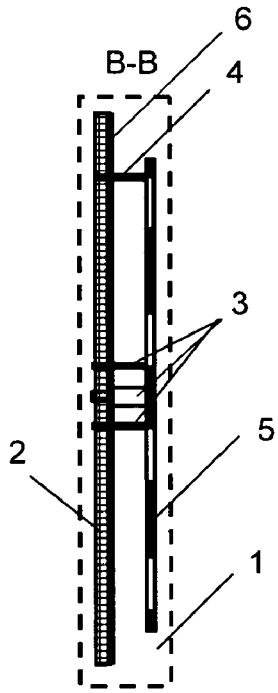
FIG. 8 shows a side view of the planar directional antenna in B-B section.

In the simplest embodiment of the invention the antenna system claimed herein (see FIG. 1 and FIG. 2) includes three planar directional antennas 1 (see FIG. 7 and FIG. 8 for details), each of which is made as dielectric plate 2 carrying a planar active element 5 of antenna 1, with said element 5 being mounted by means of mounting elements 3 and 4 in such a way that said element 5 is parallel to and spaced from said plate 2. The surface of plate 5 that faces the active element 5 is metallized and serves as reflector 6 of antenna 1. Plates 5 are interconnected along their edges in such a way as to form lateral facets 7 of frame 9 installed on base 8 and shaped as right triangular prism with metallized external surface.

Figure 3:
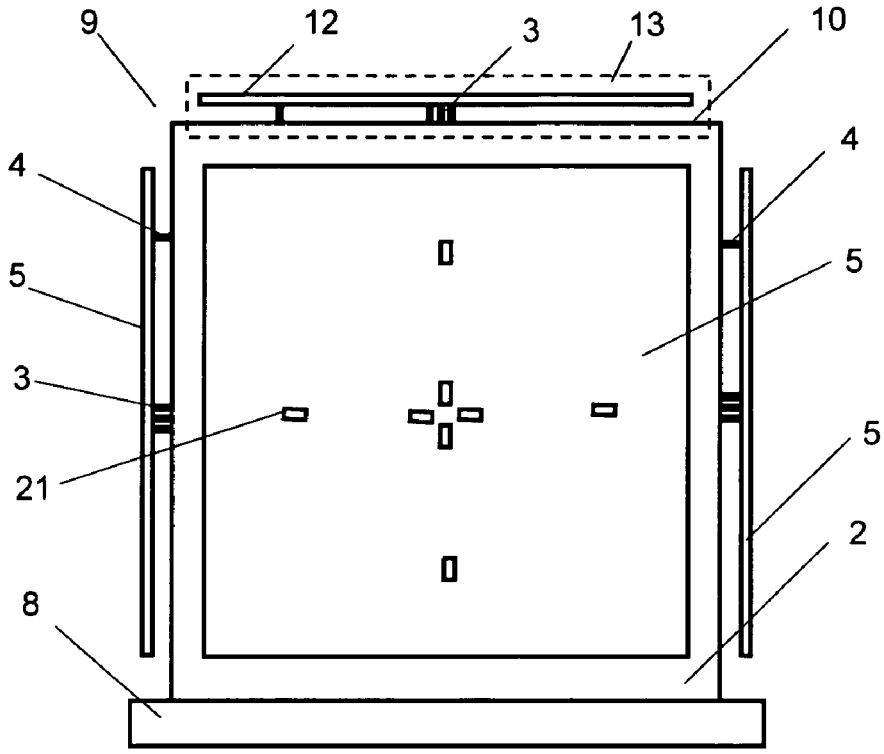
FIG. 3 shows a side view of the antenna system with the frame made as a right rectangular prism and with five directional planar antennas.
Figure 4:
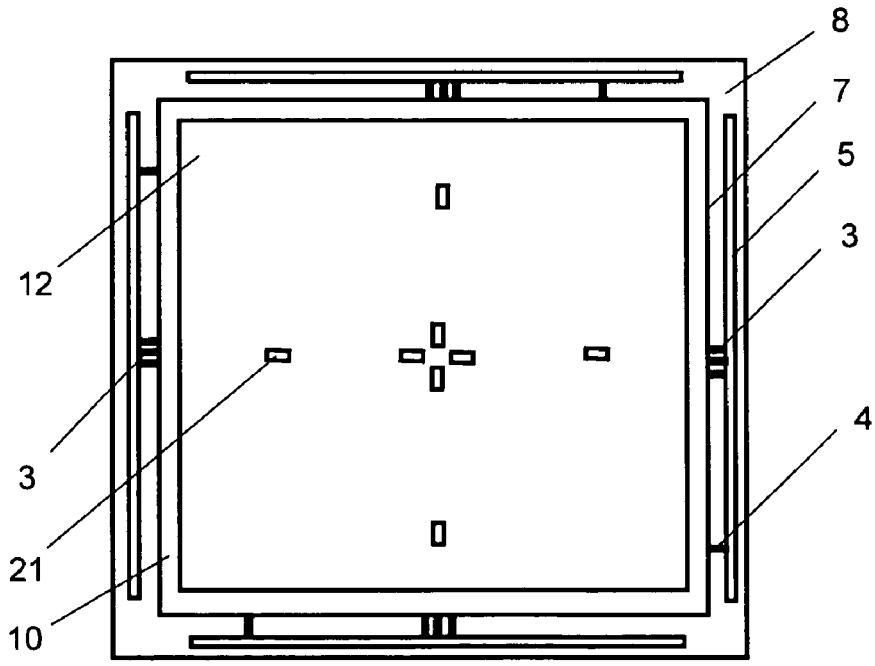
FIG. 4 shows an upper view of the antenna system of FIG. 3.
Figure 5:
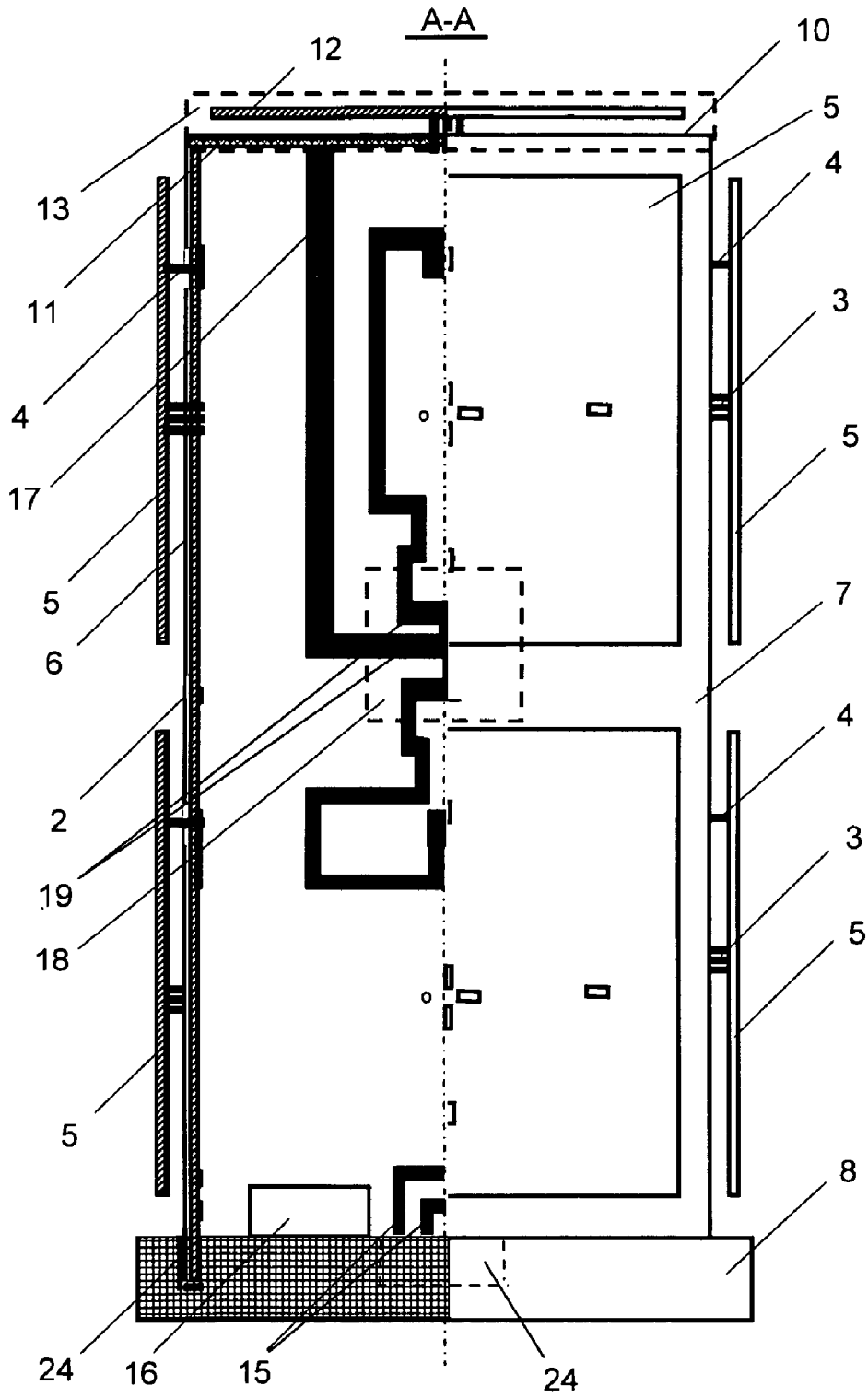
FIG. 5 shows a side view of the antenna system with the frame made as a right rectangular prism and with nine directional planar antennas (with partial A-A section)
Figure 6:
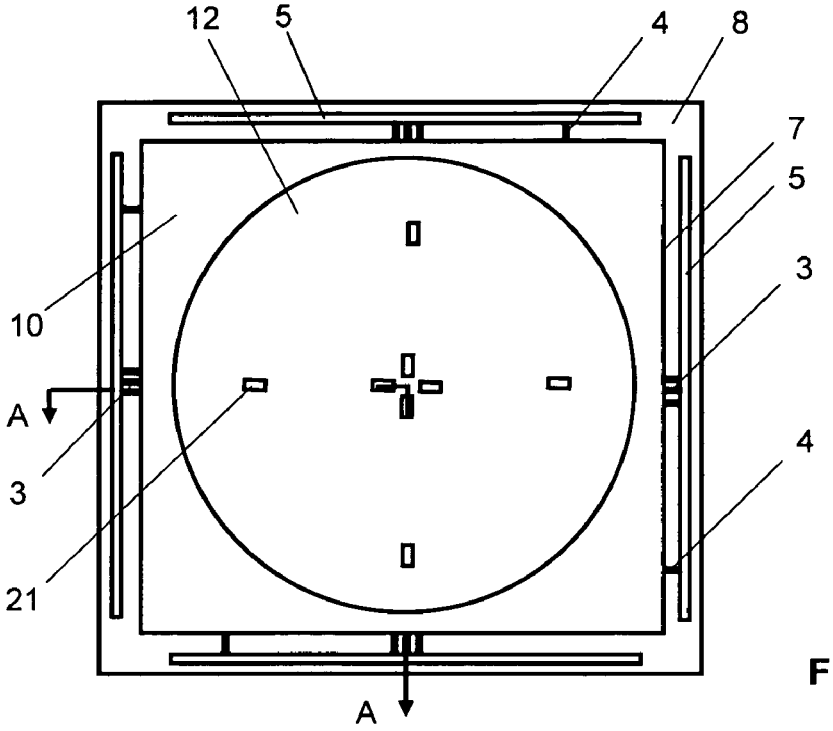
FIG. 6 shows an upper view of the antenna system of FIG. 5.

Active element 12 of planar directional antenna 13 (for which the metalized surface of plate 11 serves as reflector) may be also mounted on end face 10 of frame 9 (with said end face being made as dielectric plate with metallized external surface—see FIG. 3-FIG. 5) in such a way that said active element 12 is parallel to and spaced from said external surface. Active element 12 may be shaped as a disk (see FIG. 6). End face 10 may be shaped as any regular polygon, depending on the number of lateral facet 7 of frame 9.

Figure 14:
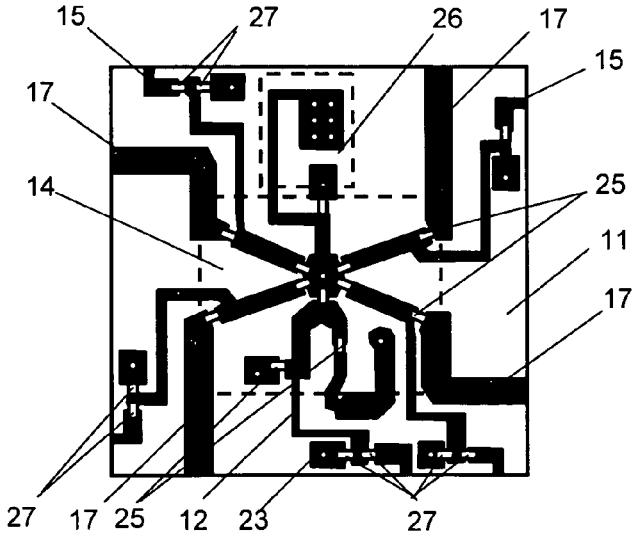
FIG. 14 shows the inner surface of the end facet of the frame.

Antenna commutation switch 14 is located on the inner surface of dielectric plate 11 that serves as end face 10 (see FIG. 14). Commutation switch 14 is connected to control unit 16 for commutation switch (see FIG. 5) by means of control communication lines, and it is connected to active elements 5 and 12 of planar antennas 1 and 3, respectively, by means of high-frequency communication lines 17.

Two active elements 5 may be mounted on each lateral facet 7 (see FIG. 5) with said pairs of active elements 5 being spaced about one another along the axis of frame 9. In this case power divider 18 made as sections of microstrip line 19 is arranged on the inner surface of plate 2 of each lateral facet 7.

Mounting elements 3 are installed in the central part of active elements 5 and 12, while mounting elements 4 are installed in the peripheral part of active elements 5 and 12. Mounting elements 3 and 4 may be of different shape (for example, they may be made in the form of pins). Mounting elements 4 are made electrically conductive and isolated from the metallized external surface of frame 9. One end of pin 4 is connected to high-frequency communication line 17, while the other end of pin 4 is connected to active element 5 of antenna 1 (on lateral facets 7) and active element 12 of antenna 13 (on end face 10).

Figure 12:
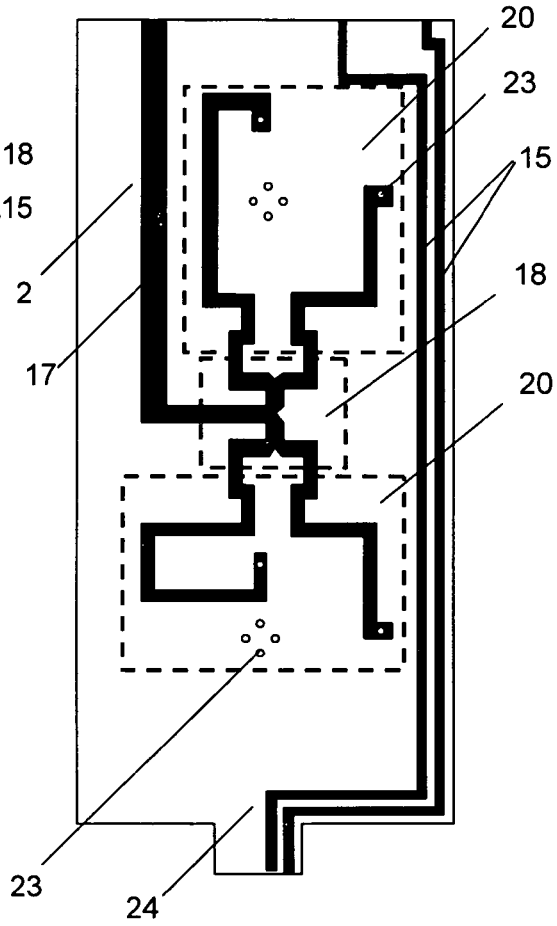
FIG. 12 shows of the inner surface of one of the lateral facet plates of the frame carrying two active antenna elements when power is fed to two points of the active antenna element.
Figure 13:
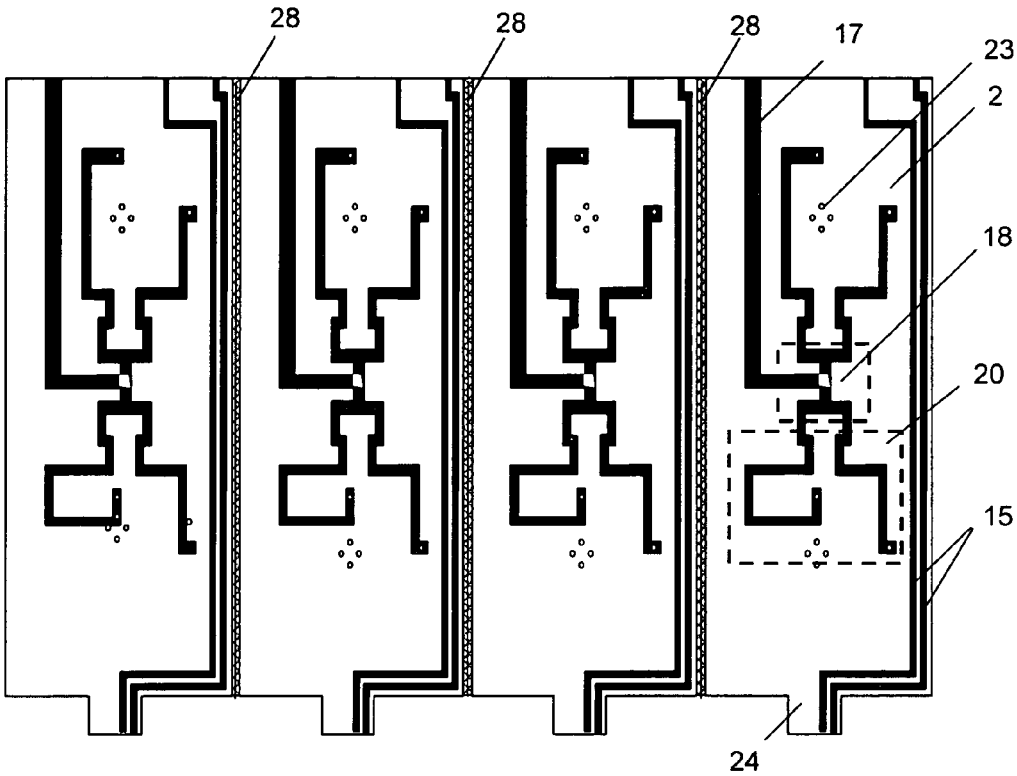
FIG. 13 shows of the inner surface of the lateral facet plates of the frame made as a single printed board with cut grooves (before it is bent into a prism)

Active elements 5 and 12 may be connected to high-frequency communication line 17 by means of pins 4 in two points located on the orthogonal straight lines passing through the center of active elements 5 and 12 (see FIG. 12-FIG. 14). In this case power dividers 18 and phase shifters 20 made as sections of microstrip lines are arranged on the inner surface of plates 2 and 11.

Figure 9:
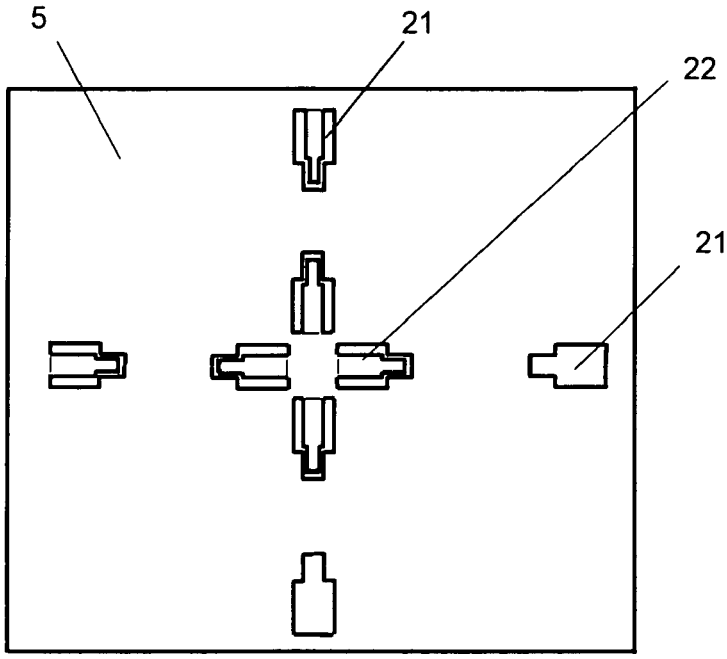
FIG. 9 shows a front view of an active element of the planar directional antenna with mounting elements in the form of pins cut in the element body (before bending)
Figure 10:
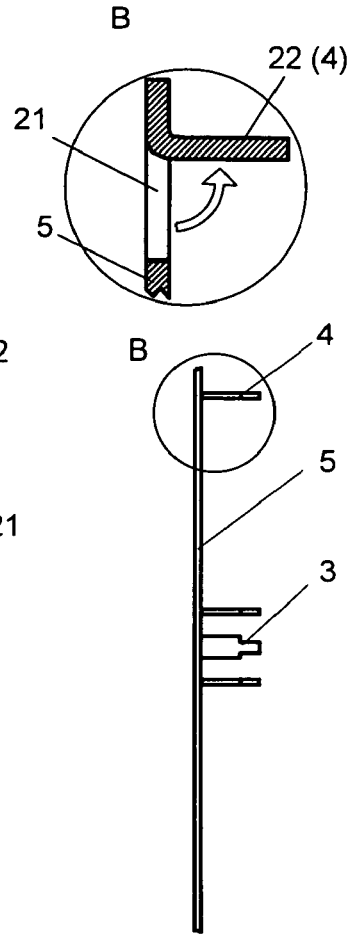
FIG. 10 shows a side view of the active element of FIG. 10 of the planar directional antenna (after the pins were bent)
Figure 11:
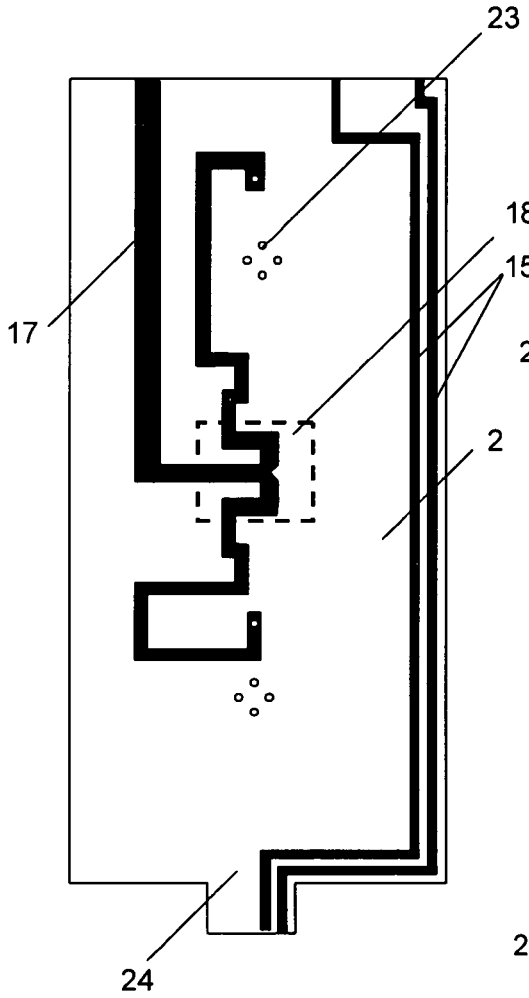
FIG. 11 shows of the inner surface of one of the lateral facet plates of the frame carrying two active antenna elements when power is fed to one point of the active antenna element.

For the purpose of simplification of the manufacturing technology for the antenna system, pins 3 and 4 may be made of the body of active elements 5 and 12 (see FIG. 9, FIG. 10) by making complex-shape grooves 21, which are subsequently bent to produce lobes 22, out of which pins 3 and 4 are to be made. Pins 3 and 4 are fixed on faces 7 and 10 (for example, by soldering the pin ends inserted into openings 23 in plates 2 and 11).

Control unit 16 for antenna commutation switch 14 may be placed either inside the frame 9 or mounted on base 8 (as shown in FIG. 5). In the latter case frame 9 may be fixed on base 8 by means of electric connectors 24 (see FIG. 5), to which the outputs of control communication lines 15 of antenna commutation switch 14 are connected. Antenna commutation switch 14 may be made through the use of diodes 25 (see FIG. 14).

A high-frequency signal is sent to the input of antenna commutation switch 14 (see FIG. 14) via the matching device 26. Signals controlling antenna commutation switch 14 are sent via resistors 27 that generate controlling potentials on diodes 25. The layouts of printed circuitry shown in FIG. 11-FIG. 14 are presented as examples of possible embodiments of the invention, and other layouts of electric circuits are also possible. Lateral facets 7 of frame 9 may be made as one printed circuit board (see FIG. 13), on the inner surface of which special grooves 28 are made (for example, by cutting). Lateral facets 7 are bent out by grooves 28 thus forming frame 9, after which soldering by edges of facets 7 is performed.

The manufacturing process for the antenna system can be automated in full. Active elements 5 and 12 of antennas 1 and 13 and radio components 25 and 27 of antenna commutation switch 14 (that are soldered, for example, by the wave soldering method) are mounted of faces 7 and 10 of frame 9 (with said faces 7 and 10 being made as printed circuit boards). End face 10 and lateral facets 7 are fixed together (for example, by soldering) at least in the sites where high-frequency communication lines 17 are coupled with control communication lines 15. Thus, mechanical joining of faces 7 and facets 10 and electric connection of communication lines 17 with communication lines 15 is performed. Antenna commutation switch 14 is connected to control unit 16 for antenna commutation switch 14 and transceiver (this unit is not shown in the Figures), for example, by means of connectors 24. Control unit 16 for antenna commutation switch 14 and transceiver may be placed on base 8 and/or in hollow frame 9 of antenna system.

The antenna system claimed herein operates in the following manner. Control unit 16 for antenna commutation switch 14 generates signals that are sent to antenna commutation switch 14 via control communication lines 15 and resistors 27. Depending on the generated control potentials, the arms of antenna commutation switch 14 can be set in a position that conducts (or does not conduct) the high-frequency signal. Combinations of control potentials make it possible to connect in the coordinated manner either one directional antenna (by choice) or several directional antennas 1, 13 to the transceiver (via antenna commutation switch 14 and high-frequency communication lines 17 made as microstrips), thus changing the configuration of the directional pattern of the antenna system. For instance, connection of antennas 1 of only one facet 7 of the antenna system provides for the reception and transmission of radio signals predominantly in the direction that is perpendicular to this face. Simultaneous connection of antennas 1 of only two adjacent facets 7 of antenna system (or simultaneous connection of antennas 1 and 13 of facet 7 and face 10) of the antenna system provides for the reception and transmission of radio signals predominantly in the direction between said facet 7 and face 10. Simultaneous connection of all antennas 1 of lateral facets 7 of antenna system provides for the omnidirectional mode for the reception and transmission of radio signals predominantly in the horizontal plane.

What is claimed is:

1. An antenna system with a controlled directional pattern, including at least three planar directional antennas, each of which is made as a dielectric plate carrying a planar active element of the above antenna mounted by mounting elements parallel to and spaced from said plate; with the plate surface that faces the active element being metallized and serving as an antenna reflector; said plates being interconnected along their edges in such a way as to form lateral facets of a hollow frame shaped as a regular prism with metallized external surfaces and set on its base; the end face of said frame being made as a dielectric plate having its external surface metallized and carrying an antenna commutation switch on the its internal surface; said antenna switch being connected to the control unit of the antenna commutation switch by means of control communications lines and connected to said active antenna elements by means of high-frequency communications lines.

2. The antenna system of claim 1, wherein said high-frequency lines are made as microstrips on the inner surface of all said frame faces; and said control communications lines are located on the inner surface of the end face and, at least, on one lateral facet of the frame.

3. The antenna system of claim 1, wherein each lateral facet of the frame carries on its external surface at least one additional planar element of the planar directional antenna mounted parallel to and spaced from said lateral facet by means of mounting elements; with said active antenna elements, which are located on the same frame facet, being vertically spaced from each other along the frame axis; and the inner surface of each lateral frame facet carrying a power divider made as sections of a microstrip line, by which the antenna commutation switch is connected to said active antenna elements.

4. The antenna system of claim 1, wherein the metallized external surface of the end face of the frame carries a planar active element of the planar directional antenna mounted by mounting elements parallel to and spaced from said external surface; the latter serving as antenna reflector; and the antenna commutation switch is connected to said active element by means of a high-frequency communications line.

5. The antenna system of claim 4, wherein said active element of the planar directional antenna located on the end face is made in the shape of a disk.

6. The antenna system of claim 1, wherein the mounting elements of the active elements of planar directional antennas are made in the form of pins.

7. The antenna system of claim 6, wherein said connection between the active element of each antenna and the high-frequency communications line is arranged by means of one of the said pins, which is electrically conductive and isolated from the metallized external surface of the frame.

8. The antenna system of claim 6, wherein said connection between the active element of each antenna and the high-frequency communications line is arranged by means of two of the said pins, which are electrically conductive and isolated from the metallized external surface of the frame; with said pins contacting said active element in points located on orthogonal straight lines passing through the center of the active element; and the inner surface of each facet carries a power divider and a phase shifter made as sections of micro strip line and connected in series, through which the antenna commutation switch is connected to the active elements of said antennas.

9. The antenna system of claim 6, wherein said pins are cut in the body of said active element and bent during mounting.

10. The antenna system of claim 1, wherein the control unit for the antenna commutation switch control unit is located inside said frame.

11. The antenna system of claim 10, wherein said antenna switch control unit is mounted on the upper base of the frame, while the frame sits on its lower base using split connectors that are connected to the outputs of the control communications lines of the antenna commutation switch.

12. The antenna system of claim 1, wherein the frame is made in the shape of a regular right prism.

* * * * *